United States Patent [19]

Howard

[11] 4,040,268

[45] Aug. 9, 1977

[54] MULTI-CIRCUITED A-COIL HEAT EXCHANGER

[75] Inventor: Webster L. Howard, Tyler, Tex.

[73] Assignee: General Electric Company, Louisville, Ky.

[21] Appl. No.: 705,621

[22] Filed: July 15, 1976

[51] Int. Cl.[2] ..... F25B 7/00; F25D 17/06; F25B 39/02; F25B 1/10

[52] U.S. Cl. ..... 62/335; 62/428; 62/504; 62/510

[58] Field of Search ..... 62/426, 428, 335, 510, 62/504, 513

[56] References Cited

U.S. PATENT DOCUMENTS

| | | | |
|---|---|---|---|
| 2,332,981 | 10/1943 | Anderson | 62/198 |
| 2,669,099 | 2/1954 | Malkoff | 62/426 |
| 2,857,747 | 10/1958 | MacCracken et al. | 62/335 |
| 3,000,193 | 9/1961 | Crider | 62/285 |
| 3,105,633 | 10/1963 | Dellario | 230/139 |
| 3,109,297 | 11/1963 | Rinehart | 62/197 |
| 3,866,439 | 2/1975 | Bussjager et al. | 62/504 |

*Primary Examiner*—Lloyd L. King
*Attorney, Agent, or Firm*—Frank P. Giacalone; Francis H. Boos

[57] ABSTRACT

The present invention provides a twin slab heat exchanger A-frame assembly having a plurality of refrigerant circuits arranged to provide a first and second circuit in each of the heat exchanger slabs. The first circuits in each heat exchanger being connected to provide the evaporator in one refrigerant system with the second circuits in each heat exchanger connected to provide the evaporator of another refrigerant circuit. The first and second circuits being arranged so that one precedes the other in air flow communication relative to air passing through the heat exchanger assembly.

8 Claims, 3 Drawing Figures

MULTI-CIRCUITED A-COIL HEAT EXCHANGER

BACKGROUND OF THE INVENTION

1. Field of the Invention:

The present invention relates to an A-shaped evaporator and more particularly to an evaporator A-coil as applied to central air conditioning systems as the indoor half of a split system with the coil being in series with the air moving device of the system. The A-coil evaporator in common practice is an assembly including two evaporator slabs that are conveniently interconnected as part of the complete refrigeration system.

2. Description of the Prior Art:

It is common to design the compressors and evaporators used in air conditioning systems according to the maximum load to which they may be subjected, and it is known in the art to reduce compressor capacity under low load conditions and to make a corresponding reduction in the evaporator surface in service. The effects of reducing the evaporator surface under these conditions is to reduce the evaporator temperature to a useful level for air conditioning and to maintain a sufficient rate of refrigerant flow for proper oil return to the compressor. By reducing the evaporator surface under low load conditions, the compressor output can be reduced accordingly to prevent excessive pressure in the evaporator. U.S. Pat. No. 2,332,981 discloses a refrigeration system wherein selected portions of an evaporator are connected to distributors which are selectively closed to remove portions of the evaporator tube surfaces from service during low load conditions. A serious drawback of multi-circuit evaporators currently used is that in many instances poor humidity control results as the evaporator circuits remaining in service are not capable of maintaining a temperature level sufficient to effectively control humidity.

Other prior attempts such as that disclosed in U.S. Pat. No. 3,866,439 provide an evaporator which comprises a plurality of refrigerant circuits connected to a plurality of distributors. The distributors being connected to the circuit in alternative ways to effect alternative refrigerant flow paths through the evaporator. Selective circuits are withdrawn from service to reduce the capacity of the evaporator under low heat load conditions.

In other attempts to reduce refrigeration capacity two or more separate refrigeration systems are employed wherein one system operates independent of the other under control of a two step thermostat. In these applications in low heat load conditions, only one system is energized with the second energized only when high heat load conditions dictate. When two separate evaporators that are arranged in the air path are employed they may be intertwined so that all of the air sees all of the refrigerant regardless of which circuit is in operation, or alternatively they may be separate heat exchangers for each circuit. In the case of intertwiningevaporators of separate refrigerant circuits, poor humidity control results when only one circuit is operating due to higheroverall evaporator temperatures. In some of the cases where separate heat exchangers are employed unacceptable stratification and uneven temperature distribution have resulted when only one heat exchanger or circuit is in use since the tendency is for a greater portion of air to flow through the inoperative relatively dry evaporator which will offer less resistance to the air flow.

SUMMARY OF THE INVENTION

By this invention there is provided a heat exchanger that is arranged in the path of a flow of air. The heat exchanger includes a pair of slab heat exchangers having leading and trailing ends with the trailing ends being substantially parallel and spaced from each other to define an opening therebetween to allow movement of air therethrough. The slabs converge toward their leading ends so that substantially all of the air moving through the opening contacts and flows through both of the slabs. Each slab includes a pair of end plates with a plurality of substantially rectangular sheet metal fins disposed in spaced parallel relation between them, there being a plurality of straight tube runs extending through aligned holes in the fins and end plates. Return bends connect selected groups of adjacent straight tube runs so as to provide a first and second sinuous circuit in each of said heat exchangers. The circuits being arranged so that substantially all of the first circuit in each slab is downstream in the air flow relative to their respective second circuit. The first circuits of each heat exchanger are connected to define an evaporator including an inlet and outlet that is connected in series in a refrigeration system. The second circuits of each heat exchanger are connected to define an evaporator including an inlet and outlet connected in series in another refrigeration system.

DESCRIPTION OF THE PREFERRED EMBODIMENT

Figure 1:
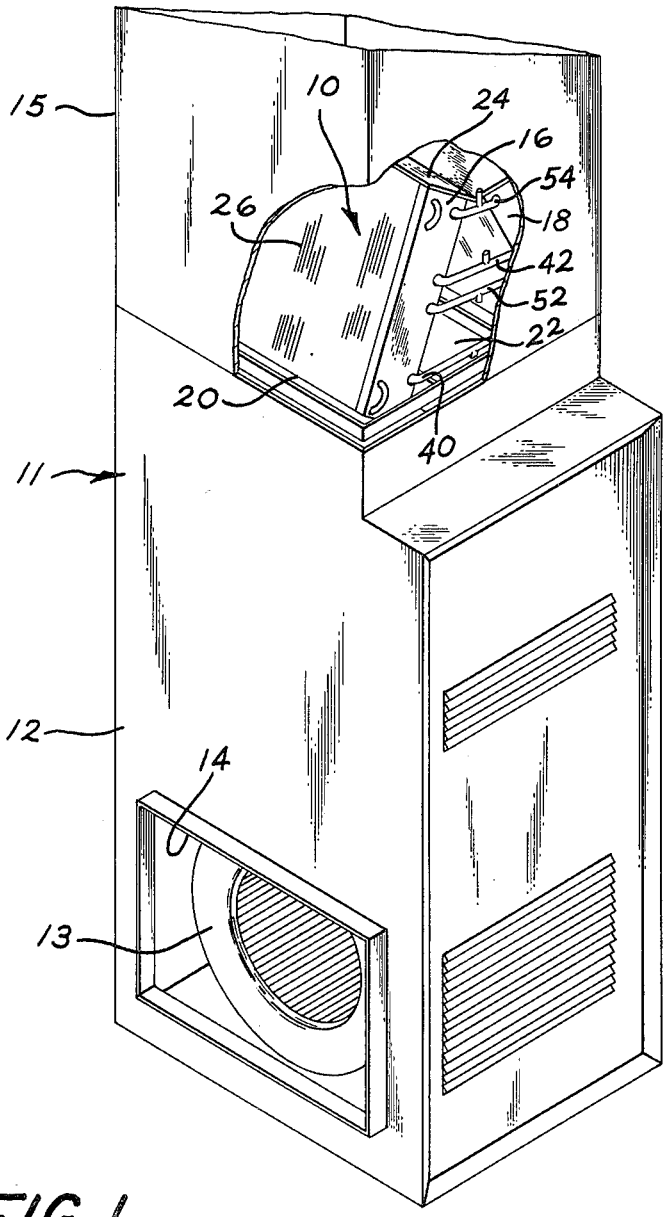
FIG. 1 is a perspective view of a conventional hot air furnace including the refrigeration heat exchange system of the present invention.

Referring now to FIG. 1 of the drawings, a heat exchanger coil package or assembly 10 incorporating the present invention is shown in combination with an upflow hot air furnace 11 that is arranged in a cabinet 12, however, it should be understood that while the present embodiment of the heat exchanger assembly 10 is shown as part of a heating system, it may be used with other type air moving devices associated with air conditioning systems that are independent of heating systems. Located in the cabinet 12 is a blower or air handling means 13 for moving air from an inlet 14 through the cabinet 12 and into a distribution plenum 15 in which the heat exchanger 10 is arranged. While the heat exchanger 10 is shown in a vertical air flow arrangement, it should be understood that it may be optionally arranged in a downflow or horizontal axial flow arrangement.

The heat exchanger assembly 10 is generally of the A-coil or inverted V-shaped configuration and as will be described more fully hereinafter contains a plurality of refrigerant circuits. The assembly 10 comprises a pair of conventional air conditioning coil or slab heat exchangers 16 and 18. When A-coil heat exchanger assemblies 10 are arranged vertically as in the present embodiment, their lower or trailing edges 20 relative to the air flow are disposed in a parallel spaced relationship to each other to define an opening 22 to allow movement of air from the blower 13. At their upper or leading edges 24 relative to the air flow the slabs 16 and 18 converge to form the A-coil configuration which in effect, locates substantially all of the downstream surface area of the slabs 16 and 18 in the path of air moving through opening 22.

Figure 3:
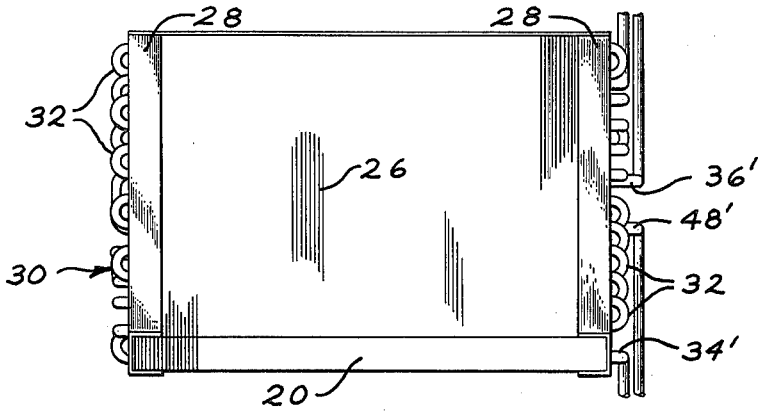
FIG. 3 a side elevational view of one heat exchange slab incorporated in the present embodiment of the invention.

Referring to FIGS. 1 and 3, it will be seen that each of the slabs 16 and 18 are generally conventional in design. The slabs 16 and 18 are fabricated from a series of flat, thin substantially rectangular plates or fins designated generally at 26. The fins 26 are arranged in spaced parallel relation between similarly shaped end plates 28 of somewhat heavier gauge. The fins 26 and plates 28 are formed with uniformly spaced and aligned holes (not shown) for the reception of refrigerant conducting coils 30. Generally the coils 30 are sinuous, presenting a series of straight sections (not shown) passing through aligned holes in the fins 26 and plates 28 that are selectively connected outside of end plates 28 by return bends 32 to complete a sinuous tubular conduit representing an evaporator circuit.

As mentioned hereinbefore, the assembly 10 represents a heat exchange system incorporating a plurality of evaporator circuits which may, as will be explained later, be connected to separate but cooperating refrigeration systems. In accordance with the present embodiment of the invention the exact length and arrangement of each evaporator and their location relative to the air flow is determined in part by the arrangement of, and the number of return bends 32.

Figure 2:
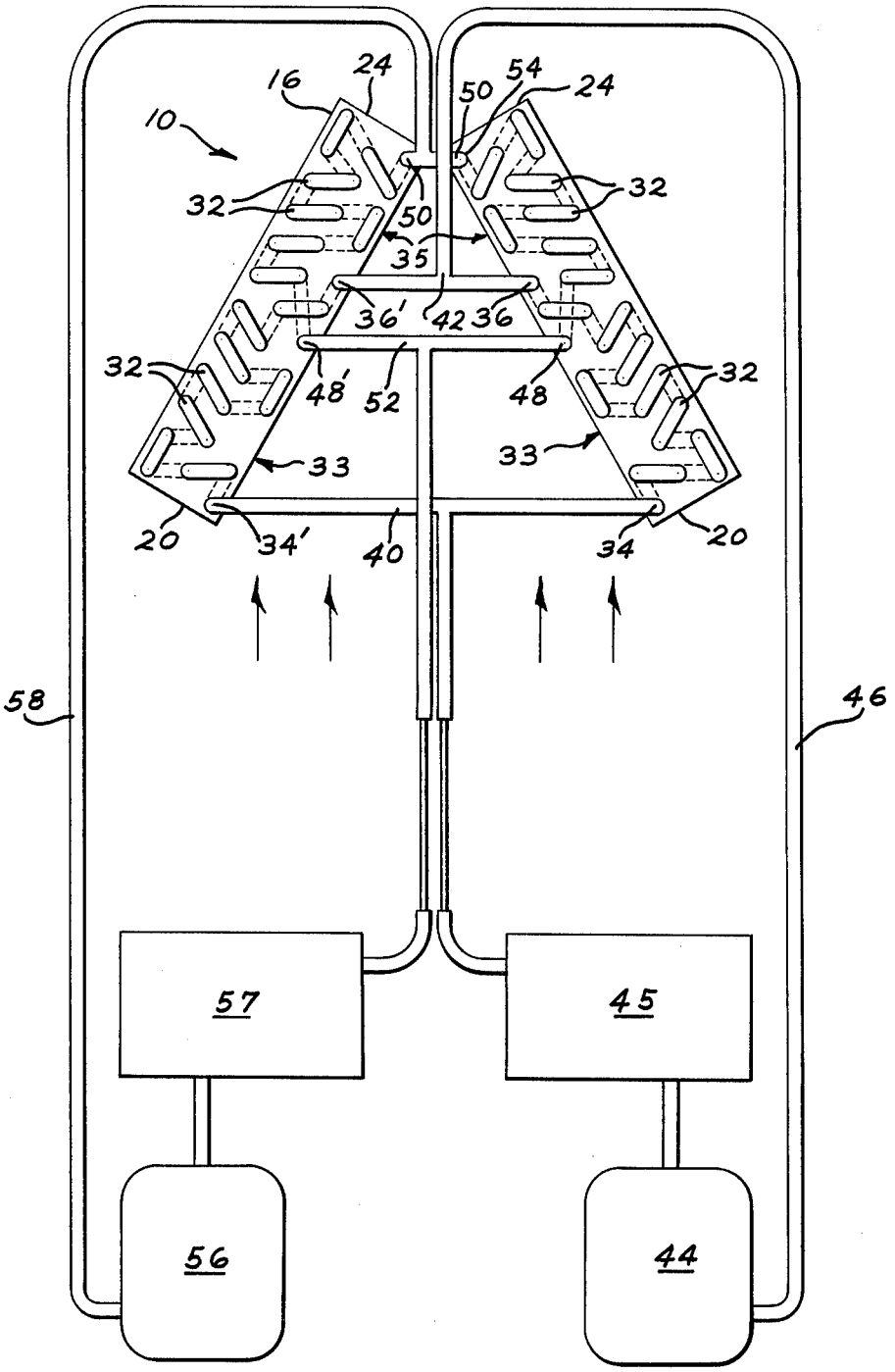
FIG. 2 is a schematic of an air conditioning system employing a heat exchange system of the present invention.

With reference to FIG. 2 of the drawing, it will be seen that two complementary evaporator circuits 33 and 35 are arranged in each of the slabs 16 and 18 and accordingly the circuits of only slab 16 will be followed, with like parts of slab 18 designated as prime numbers.

The circuit 33 is arranged downstream of circuit 35 and accordingly its inlet is adjacent the trailing or lower edge portions 20 of the slabs. In order to insure that most of the air passing through the assembly 10 engages the surface areas adjacent circuit 33 prior to circuit 35 substantially all of circuit 33 is arranged in the lower or upstream half of the slab. Accordingly, refrigerant flow starts from an inlet 34 located adjacent edge 20, through a series of adjacent straight lines arranged transversely through fins 26, appropriately arranged return bends 32 secured to the straight line on opposite sides of the slab and outlet 36 arranged near the middle section of the slab relative to air flow to complete lower or downstream circuit 33. The inlets 34, 34' of each of the circuits 33 are connected by a conduit 40 while the outlets 36,36' thereof are connected by a conduit 42 so that circuits in each slab are connected in parallel to complete evaporator 33. The evaporator 33 is part of a refrigeration system including a compressor 44 from which a line leads to a condenser 45 having a discharge line including an expansion device connected to the conduit 40 with a suction line 46 connecting conduit 42 to the compressor 44.

The evaporator circuit 35 which is arranged above or downstream of the air flow starts at the inlet 48 located adjacent the outlet 36 of circuit 33. Circuit 35 continues similarly as circuit 33 through a series of adjacent straight lines and return bends 32 to an outlet 50 at the upper end of the slab. Inlets 48, 48' are connected by conduit 52 while the outlets 50 are connected by conduit 54 so that circuits in each slab are connected in parallel to form evaporator 35. The evaporator 35 is part of a refrigeration system including a compressor 56 from which a line leads to a condenser 57 having a discharge line including an expansion device connected to the conduit 52 with a suction line 58 connecting the conduit 54 to the compressor 56.

In summary it should be apparent that by the present invention there is provided an A-coil heat exchanger wherein the evaporator circuit of one refrigeration system is disposed in the lower or leading half of each slab relative to air flow indicated by arrows in FIG. 2 with the evaporator circuit of another refrigeration system being disposed in the upper or trailing half of each slab relative to air flow. While in the embodiment shown the circuits comprising an evaporator in each slab are connected in parallel it may be advantageous in certain design requirements that they be connected in series.

The problems of air stratification and humidity control have been substantially eliminated when, as in the present invention, half of each slab relative to air flow of an A-coil is circuited to be part of a refrigeration system independent of the other half of each slab which is circuited to be part of another refrigeration system.

The concentration of the refrigerant circuit in a smaller area as opposed to intertwined circuits that extend the full length of a heat exchanger result in lower surface temperatures and accordingly a higher degree of humidity control. The spreading out of the refrigerant circuit on across substantially the total air flow path plus the fact that even when one coil is inactive air flows through an active coil as well results in eliminating substantially all air stratification problems that are encountered when air is allowed to pass directly through uncooled surfaces.

The foregoing is a description of the preferred embodiment of the invention. In accordance with the Patent Statutes, changes may be made in the disclosed apparatus and the manner in which it is assembled without actually departing from the true spirit and scope of this invention, as defined in the appended claims.

What is claimed is:

1. In a heat exchanger arranged in the path of a flow of air including a pair of slab heat exchangers having leading and trailing ends, said trailing ends being substantially parallel and spaced from each other to define an opening therebetween to allow movement of air therethrough, said slab heat exchangers converging toward said leading end so that substantially all of the air moving through said opening contacts and flows through both of said heat exchangers, each of said slab heat exchangers having a pair of end plates, a plurality of substantially rectangular sheet metal fins disposed in spaced parallel relation between said end plates, wherein the improvement comprises:

a plurality of straight tube runs extending through aligned holes in said fins and said end plates, a plurality of return bends associated with each of said slab heat exchangers being located outwardly of said end plates connecting selected groups of adjacent straight tube runs so as to provide a first sinuous circuit in each of said slabs arranged so that one end of said first circuit is adjacent the trailing ends thereof and a second sinuous circuit arranged substantially between the first circuit and the leading ends of each of said slab heat exchangers being arranged so that substantially all of said first circuit in each heat exchanger is downstream in said air flow relative to their respective second circuit.

2. The invention defined in claim 1 wherein, conduit means connecting the first circuits of each heat exchanger to define an evaporator including an inlet and outlet connected in series in a refrigeration system;

a second conduit means connecting the second circuits of each heat exchanger to define an evaporator including an inlet and outlet connected in series in another refrigeration system.

3. The invention defined in claim 2 wherein the first circuit of each heat exchanger are connected in parallel.

4. The invention defined in claim 3 wherein the second circuit of each heat exchanger are connected in parallel.

5. In a refrigeration system evaporator having portions of at least two refrigeration circuits being arranged in the path of a flow of air comprising:

a pair of heat exchangers having leading and trailing ends, said trailing ends being substantially parallel and spaced from each other to define an opening therebetween to allow movement of air therethrough, said heat exchanger converging toward said leading end so that substantially all of the air moving through said opening contacts and flows through both of said heat exchangers, each of said heat exchangers having a pair of end plates, a plurality of substantially rectangular sheet metal fins disposed in spaced parallel relation between said end plates;

a plurality of straight tube runs extending through aligned holes in said fins and said end plates, a plurality of return bends associated with each of said heat exchangers being located outwardly of said end plates connecting selected groups of adjacent straight tube runs so as to provide a first sinuous circuit in each heat exchanger arranged so that one end of said first circuit is adjacent the trailing ends thereof and a second sinuous circuit arranged substantially between the first circuit and the leading ends of each of said heat exchangers being arranged so that substantially all of said first circuit in each heat exchanger is downstream in said air flow relative to their respective second circuit.

6. The invention defined in claim 5 wherein, conduit means connecting the first circuit of each heat exchanger to define an evaporator including an inlet and outlet connected in series in a refrigeration system;

a second conduit means connecting the second circuit of each heat exchanger to define an evaporator including an inlet and outlet connected in series in another refrigeration system.

7. The invention defined in claim 6 wherein the first circuit of each heat exchanger are connected in parallel.

8. The invention defined in claim 7 wherein the second circuit of each heat exchanger are connected in parallel.

* * * * *